US006338387B1

(12) United States Patent
Mouton et al.

(10) Patent No.: US 6,338,387 B1
(45) Date of Patent: Jan. 15, 2002

(54) DOWNWARD ENERGIZED MOTION JARS

(75) Inventors: David E. Mouton, Mandeville; William J. Mouton, Jr., New Orleans, both of LA (US)

(73) Assignee: Downhole Research, LLC, LA (US)

( * ) Notice: Subject to any disclaimer, the term of this patent is extended or adjusted under 35 U.S.C. 154(b) by 0 days.

(21) Appl. No.: 09/437,871

(22) Filed: Nov. 10, 1999

Related U.S. Application Data

(60) Provisional application No. 60/110,232, filed on Nov. 30, 1998.

(51) Int. Cl.[7] ..... E21B 31/107

(52) U.S. Cl. ..... 166/301; 166/178; 175/299; 175/304

(58) Field of Search ..... 175/299, 304, 175/300, 302, 297; 166/178, 301

(56) References Cited

U.S. PATENT DOCUMENTS

| | | | | | |
|---|---|---|---|---|---|
| 1,977,110 | A | | 10/1934 | Burns et al. | 255/27 |
| 2,008,743 | A | | 7/1935 | Black | 255/27 |
| 2,126,241 | A | | 8/1938 | Black | 255/27 |
| 2,144,100 | A | | 1/1939 | Bishop | 255/27 |
| 2,144,869 | A | | 1/1939 | Boulter | 255/27 |
| 2,166,299 | A | | 7/1939 | Kennedy et al. | 255/27 |
| 2,621,025 | A | * | 12/1952 | Denning | 175/304 |
| 2,634,102 | A | * | 4/1953 | Howard | 175/296 |
| 2,801,078 | A | * | 7/1957 | Medders et al. | 175/232 |
| 2,819,878 | A | | 1/1958 | Beck | 255/28 |
| 2,896,917 | A | * | 7/1959 | McGarrahan | 175/299 |
| 3,203,782 | A | * | 8/1965 | Lyles | 175/299 |
| 3,406,770 | A | * | 10/1968 | Arterbury | 175/299 |
| 4,333,542 | A | * | 6/1982 | Taylor | 175/299 |
| 4,607,692 | A | * | 8/1986 | Zwart | 166/178 |
| 4,694,917 | A | | 9/1987 | Heidemann et al. | 175/299 |
| 5,170,843 | A | * | 12/1992 | Taylor | 166/301 |
| 5,503,228 | A | * | 4/1996 | Anderson | 166/301 |

* cited by examiner

*Primary Examiner*—Hoang Dang
(74) *Attorney, Agent, or Firm*—Garvey, Smith, Nehrbass& Doody, LLC

(57) ABSTRACT

An apparatus for jarring a portion of drill string lodged within a borehole, by jarring downhole using tension only, including a first member for attaching a first lower end of the apparatus to the upper end of the lodged tool or pipe through a threadable attachment; a second member for attaching a second end of the apparatus to a drill string on its upper end portion; a third anvil or hammer member which is triggered by spring having stored compressional force transferred by tension from the drill string to the apparatus when the drill string is pulled upward. There is also provided an actuator for rapidly releasing the tension force provided by the spring downward onto the stuck pipe in order to provide an impacting, downward force onto the pipe in an effort to dislodge the pipe. There is further provided a slow release mechanism for slowly releasing the tension force stored by the spring in the event the tool is not fired downhole.

27 Claims, 6 Drawing Sheets

DOWNWARD ENERGIZED MOTION JARS

CROSS-REFERENCE TO RELATED APPLICATIONS

Priority of U.S. Provisional Patent Application Ser. No. 60/110,232, filed Nov. 30, 1998, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The apparatus of the present invention relates to jarring tools used in downhole drilling. More particularly, the present invention relates to an improved apparatus for jarring stuck tools, including pipe, downhole and a method of achieving same.

2. General Background of the Invention

In the art of drilling wells for recovery of hydrocarbons, the process incorporates a drill string which comprises a plurality of threaded tubular members such as drill pipe being approximately 30 foot each in length, the drill pipe threaded end to end which is then used to rotate the drill bit either from the surface or through the use of a drill motor which would rotate the bit without the rotation of the drill pipe itself. Often times during that process, the drill string will become lodged at a certain point along its length within the borehole.

In the efforts to dislodge the drill pipe or other tools lodged downhole, a type of tool known as a jarring tool would be used in such an attempt. In the current state of the art, jarring tools as they currently utilize may be used to either jar the stuck or the lodged portion of pipe either in the up or down direction, depending on the makeup of the tool. In most cases, it would be more desirable to jar down on the pipe than to jar up. The reason for this is that drill pipe will usually get lodged when it is being pulled up as opposed to being moved downward, so jarring downward will more likely free the pipe. In such a case, the pipe is probably wedged against an obstruction caused by the upper movement of the pipe, and jarring upward may tend to wedge the debris around the section of pipe even tighter.

Methods of downward jarring which are currently used in the art includes applying compression on the drill string to which a down jar has been attached, whereby the jar releases at a pre-set load, allowing the hammer of the jar to freely travel a short distance impacting the anvil of the tool, delivering a downward blow. The effectiveness of this method has limitations, due to compressional buckling of the drill string, as well as drag. Therefore, it is often difficult to achieve a large downhole jarring force in a vertical well, and the problem is exacerbated in the horizontal portion of a directional drilling operation. A jar in the upward direction can be attached to the top of the stuck pipe or tool, and the jar can be pulled upward until it is tripped. While this type of jarring can produce more force than downward jarring, it is typically in the wrong direction for most instances of stuck pipe.

Certain patents have been obtained which address the method of jarring pipe loose from a borehole, and these will be provided in the prior art statement submitted herewith.

BRIEF SUMMARY OF THE INVENTION

The apparatus of the present invention solves the problems in the art in a simple and straight forward manner. What is provided is an apparatus for jarring a portion of drill string lodged within a borehole, by jarring downward using tension versus compression. The apparatus would include a first member for attaching a first lower end of the apparatus to the upper end of the lodged tool or pipe through a threadable attachment; there would then be provided a second member for attaching a second end of the apparatus to a drill string on its upper end portion; there is further provided a third anvil or hammer member which is triggered by a spring having stored compressional force transferred by tension from the drill string to the apparatus when the drill string is pulled upward. There is also provided an actuator for rapidly releasing the tension force provided by the spring downward onto the stuck pipe in order to provide an impacting, downward force onto the pipe in an effort to dislodge the pipe. There is further provided a slow release mechanism for slowly releasing the tension force stored by the spring.

Therefore, it is the principal object of the present invention to provide a tool for dislodging drill pipe down a borehole, which provides for a downward jarring on the stuck pipe or tool to facilitate dislodging of same;

It is another principal object of the present invention to provide an apparatus for dislodging pipe or tools from a borehole by imparting a downward force, yet disallowing the weight of the hammer member from imparting additional, undesirable force on the surface mechanisms;

It is a further object of the present invention to provide a jarring tool which has an internal mechanism for regulating the amount of force that is imparted onto the stuck object lodged within the borehole, yet provides for sufficient force to dislodge the pipe or tool within the borehole;

It is a further object of the present invention to provide a method of dislodging tools stuck down a borehole which includes providing a tool having a first portion secured to the lodged tool, a second portion secured to the tubing above the tool, and a third portion defining a means for imparting jarring force against the stuck tool, while moving independently of the second portion to prevent undesired force on the elements above the tool.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein:

FIG. 6A illustrates an exploded partial view of the three members of the apparatus as they relate to one another; while

FIG. 11A illustrates a cross section view of the secondary metering system used in the jarring mechanism working in conjunction with the fluid reservoir in the present invention, while

DETAILED DESCRIPTION OF THE INVENTION

Figures 1, 2, 3, 4, 5:
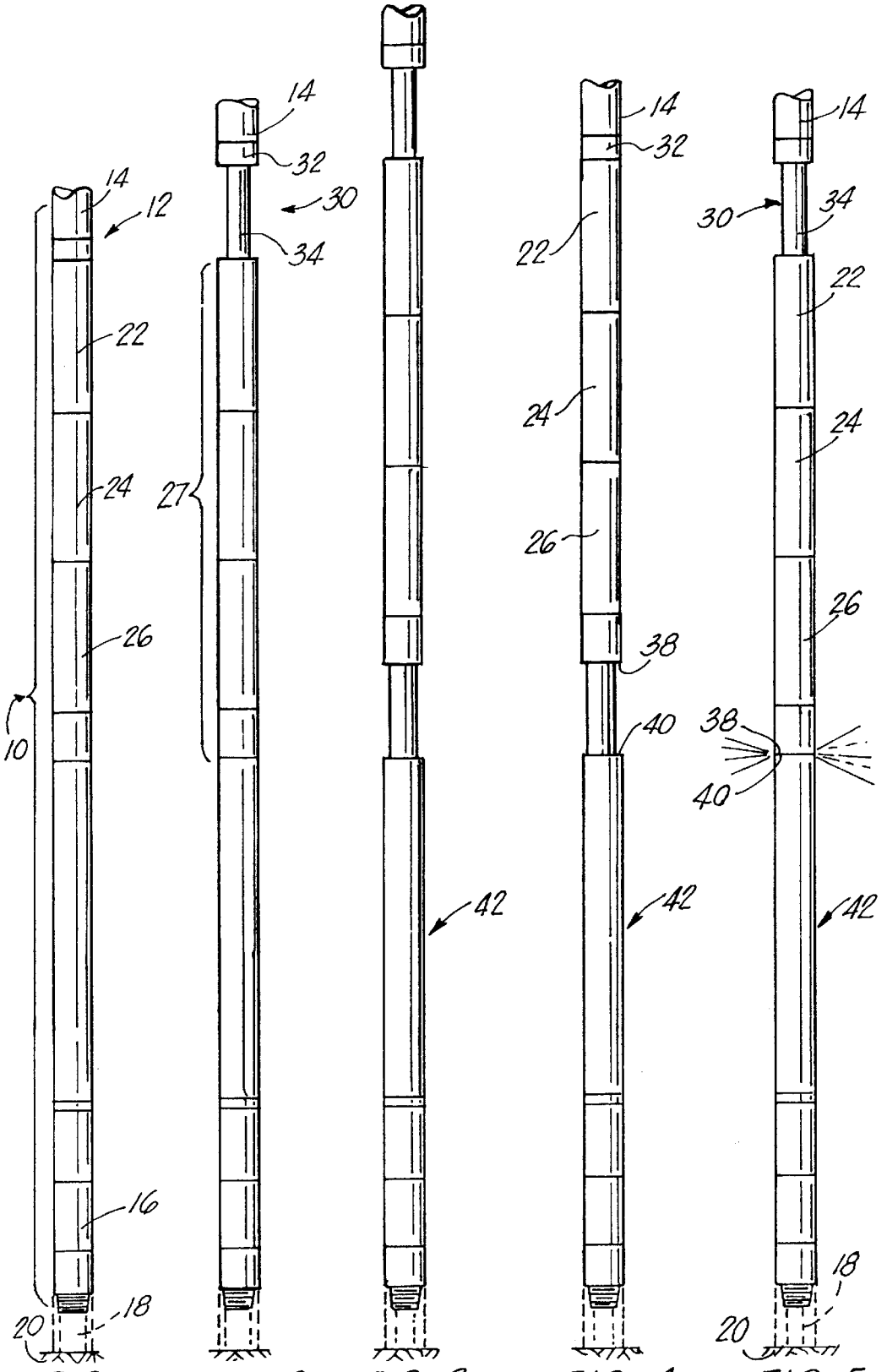
FIG. 1 illustrates an overall outer view of the preferred embodiment of the apparatus of the present invention as it would be positioned downhole.
FIG. 2 illustrates an outer view of the apparatus as seen in FIG. 1 moving into the cocked position for firing.
FIG. 3 illustrates an outer view of the apparatus in FIG. 1 fully cocked and ready to be fired in the bore hole.
FIGS. 4 and 5 illustrate views of the preferred embodiment of the apparatus of the present invention as it is fired to impart downward force on the drill pipe lodged in a borehole.

FIGS. 1 through 11C illustrate the preferred embodiment of the present invention by the numeral 10, as it would generally appear undertaking the process of dislodging a section of pipe or tools from the borehole. It should be noted that in general, apparatus 10 comprises three principal components. The first component comprises an upper section or member 12 secured to tubing, such as a drill pipe, coil tubing, or wireline, depending on the type of tool lodged downhole. There is provided a second lower member 16 secured to the tool or drill pipe lodged downhole, and a third "jarring" member 27, comprising the hammer portion of the apparatus, which when fired, imparts downward force, striking the lower member 16 secured to the stuck tool or pipe.

Turning first to FIG. 1, there is illustrated apparatus 10 secured at the upper portion 12 to a section of drill pipe 14 and at it's lower portion 16 to a tool or a portion of drill pipe 18 which has become lodged down the borehole by formation 20. As further illustrated, the third "jarring member" 27 of apparatus 10 would further comprise a plurality, or preferably three drill collars 22, 24, 26, in succession, in order to provide the requisite amount of mass to the "jarring" member 27 of the apparatus when the jarring takes place, so as to free the stuck pipe 18.

Figure 6A:
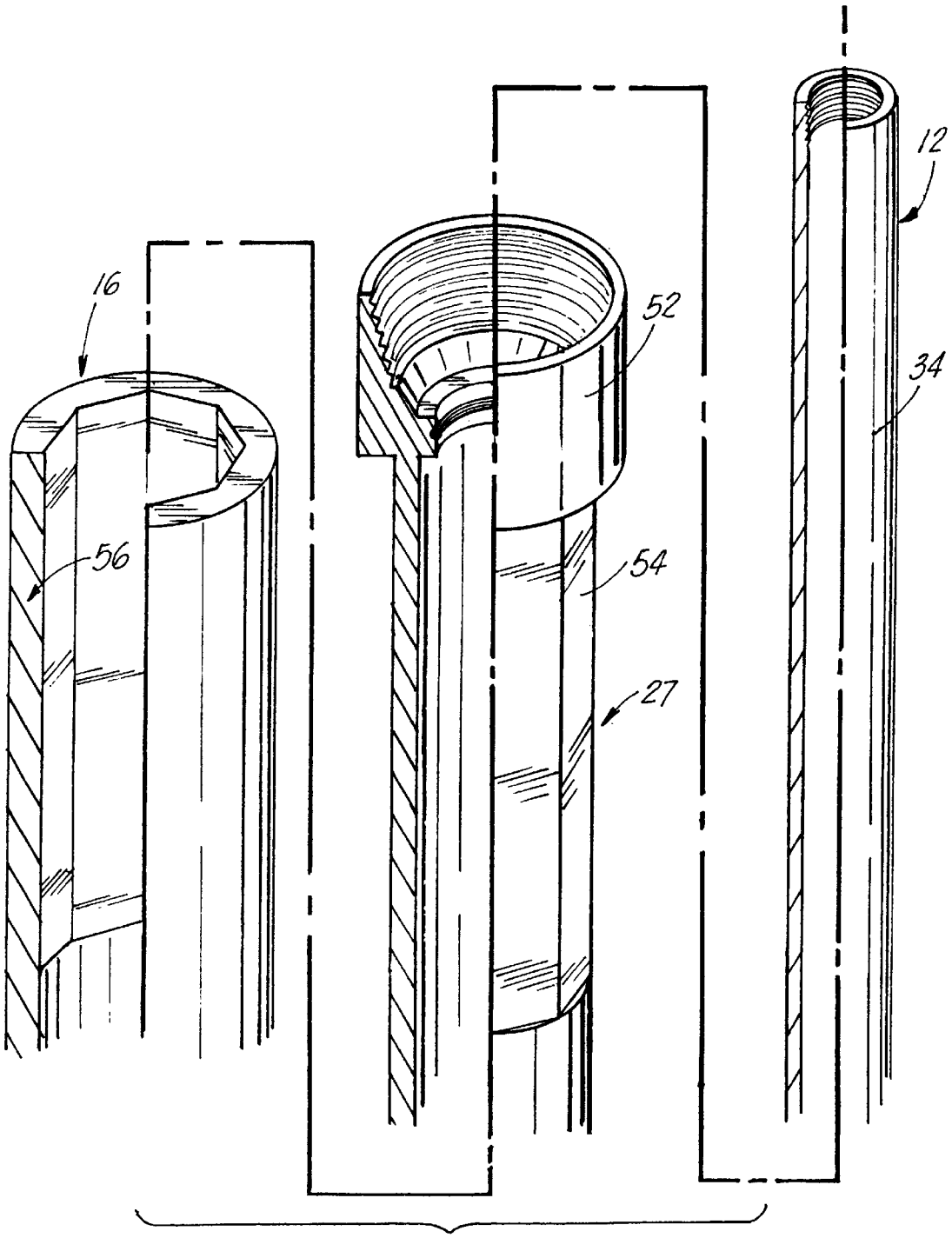

In FIG. 2, there is illustrated a portion of the upper portion 12 which includes an actuator sub 30, including the tension tube 34, which is secured to the upper portion of drill pipe 14 through the upper attachment portion 32 of upper portion 12. The upper attachment portion 32 is secured to the tension tube portion 34 which would be pulled upward to compress an internal spring (not illustrated), and to set the firing mechanism so that the jarring portion 27 of the apparatus is locked in place ready to fire as seen in FIG. 3. Upon reaching a certain point of travel, the drill pipe 14 would be lowered as seen in FIG. 4, the jarring unit 27 would be fired, and the internal spring would expand rapidly forcing the hammer and connected drill collars 22, 24, 26 to impact the shoulder 38 of the jarring unit 27 against shoulder 40 of upper portion 42 of the lower portion 16 of tool 10, as seen in FIG. 5, which in turn would jar the stuck tool or pipe 18. This would be repeated until the tool is free. FIGS. 1 through 5 illustrate a general outer views of the operation of the apparatus 10, while FIG. 6A illustrates the relationship of the three members of the apparatus, namely the upper member 12, the lower member 16, and the jarring member 27, as they slidably engage into one another to form the composite apparatus. This interrelationship will be explained for fully, through FIGS. 6B through 11C which illustrate the details of the apparatus in its operation.

Figure 6B:
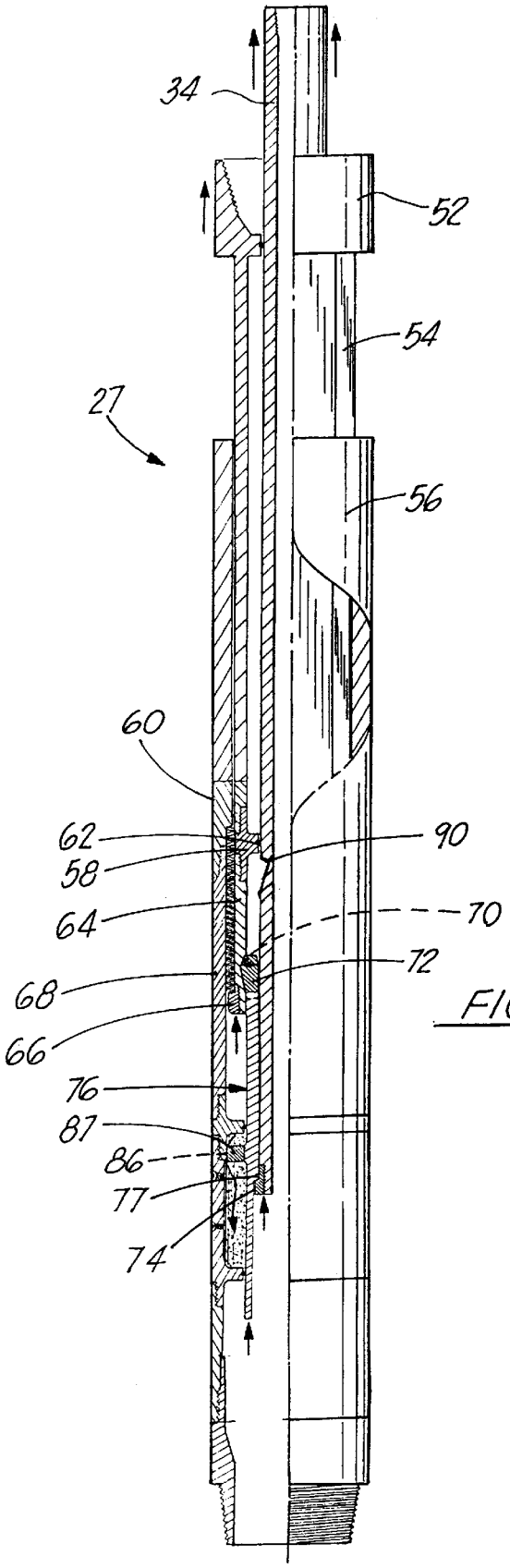
FIG. 6B illustrates a partial cut away view of the jarring lower portion of the apparatus as it is being moved into the firing position.

FIG. 6B illustrates a partial cutaway view of jarring member 27 of the apparatus of the present invention moveable within the lower portion 16 secured to a lodged tool 18. As illustrated, the jarring member 27, includes a tension tube 34. The hammer portion of the tool has an upper head portion 52 moveable within the jarring member 27 and would be slidably engaged within outer body 56 of lower attachment portion 16. Hammer sub 54 would terminate at a flanged collar connector 58, having an internal shoulder 60, with an o-ring 62 for sealing the space between shoulder 60 and tension tube 34. Below the collar connector 58 there is provided the cylindrical body 64 which terminates in an outer flange 66 for supporting the lower end of spring means 68 as illustrated. For purposes of construction, spring means 68 would preferably comprise a belleville spring, of the type known in the industry, or may comprise a fluid or hydraulic spring means. The inner face of the lower end of cylindrical body 64 would include a continuous concavity 70 around its inner face so as to accommodate the latch means 72 as seen in the figures, and as will be discussed further. As seen further in the FIG. 6B, the tension tube 34 terminates in a flanged collar portion 74 to raise and cock the hydraulic piston 76. As illustrated in FIG. 6B, the latch means 72 is engaged within the concavity 70 around the inner face of the body 64. When upward force is placed upon the tension tube 34, by pulling on the upper tubing, the flanged collar portion 74, which has engaged the lower end 77 of hydraulic piston 76, begins to lift the cylindrical body 64, which in turn compresses the spring 68.

Figure 7:
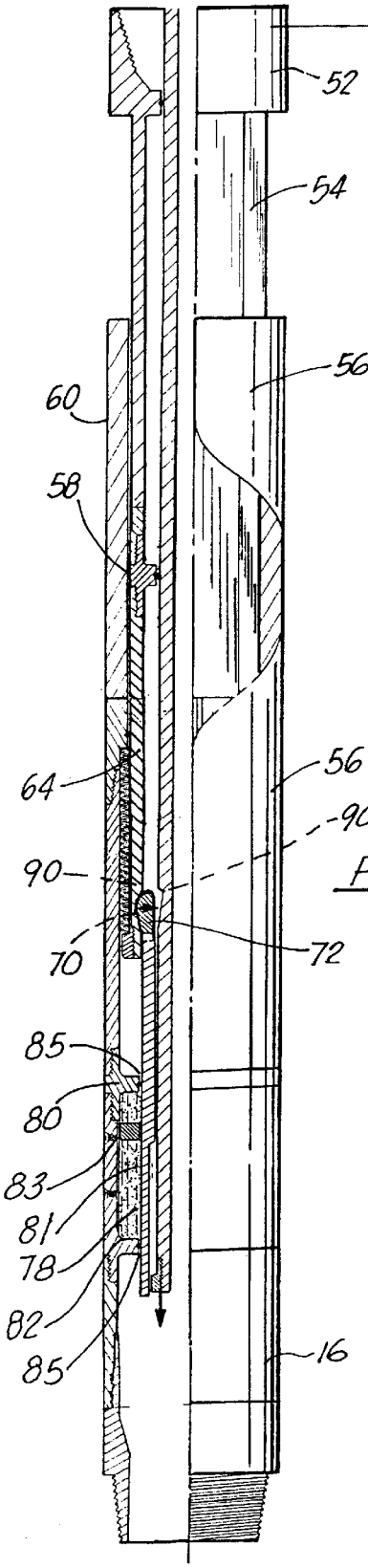
FIG. 7 illustrates a partial cut away view of the lower jarring portion of the apparatus of the present invention as it is ready to be fired.
Figure 8:
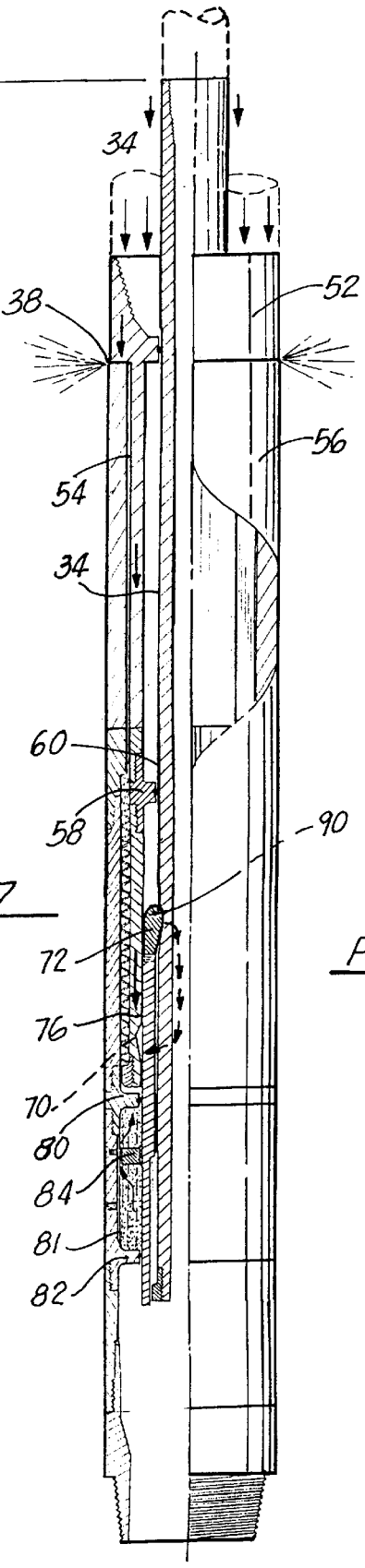
FIG. 8 illustrates a partial cut away view of the lower jarring portion of the apparatus of the present invention at the point that the apparatus is fired.

Turning now to the lower portion of the jarring portion 27 there is provided a hydraulic means for sustaining the compressional energy now stored by spring 68, to allow the tension to be to be lowered to fire the mechanism. As illustrated in FIG. 7, there is provided a hydraulic reservoir 78 which is formed between a first upper flanged collar 80, and a second lower flanged collar 82, in the wall of the outer body 56 of the jarring member 27. As seen in FIGS. 7 and 8, the reservoir 78 contains a quantity of hydraulic fluid 81, which is placed in the reservoir via access screws 83, allowing access into reservoir 78. It should be noted that the inner surfaces of each flanged collar 80, 82 is provided with an o-ring 85 so as to maintain hydraulic fluid 81 within the reservoir during operation of the tool. The piston 76 would include a check valve portion 84, having a one way check valve 86, so that as the piston 76 moved upward or downward, the check valve 86 positioned on a flanged collar 87 would allow the fluid to travel between those points above and below the flanged collar 87 so the piston may move upward rapidly but downward movement is retarded due to the metering action of the piston.

In FIG. 6B, the piston 76 has been raised to a point where spring 68 is fully compressed and the tool is ready to fire. As seen in FIG. 7, the tension tube is lowered where upon the latch means 72 reaching the conical groove 90 in the wall of tension tube 34, the latch means 72 disengages from conical groove 70 in the wall of tension tube actuator 54, and moves into conical groove 90 in the wall of tension tube 34. When this occurs, spring 68 is allowed to expand, and together with the mass provided by drill collars 22, 24, 26, provides significant downward force on the jarring member 27, so that the head 52 makes a substantial impact on the upper end of outer body 56, which imparts a downward jar to the stuck drill pipe 18. It is important to note that because of the three member configuration of the apparatus, the tension tube 34 allows free movement of the mass of the three drill collars 22, 24, 26, attached to the actuator portion 54 so that when the jarring function of the tool is undertaken as explained above, the drill string is isolated from potential damage that would occur if the upper tubing was directly attached to the jarring member 27. Furthermore, drag forces are minimized on the jarring system because of its independent movement.

Figure 9A:
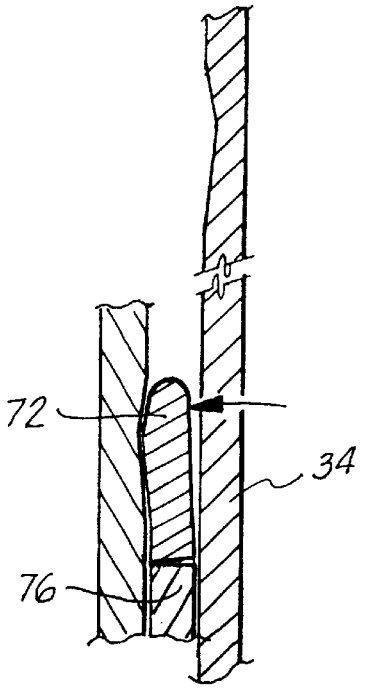
FIGS. 9A and 9B illustrate views of the latching means used in the apparatus of the present invention.
Figure 10:
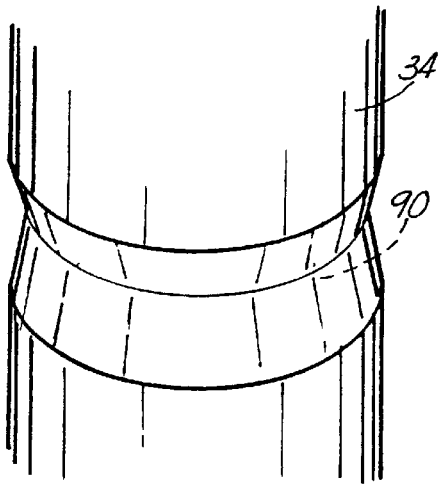
FIG. 10 illustrates a partial view of the internal cut away provided in the tension member of the present invention.
Figure 9B:
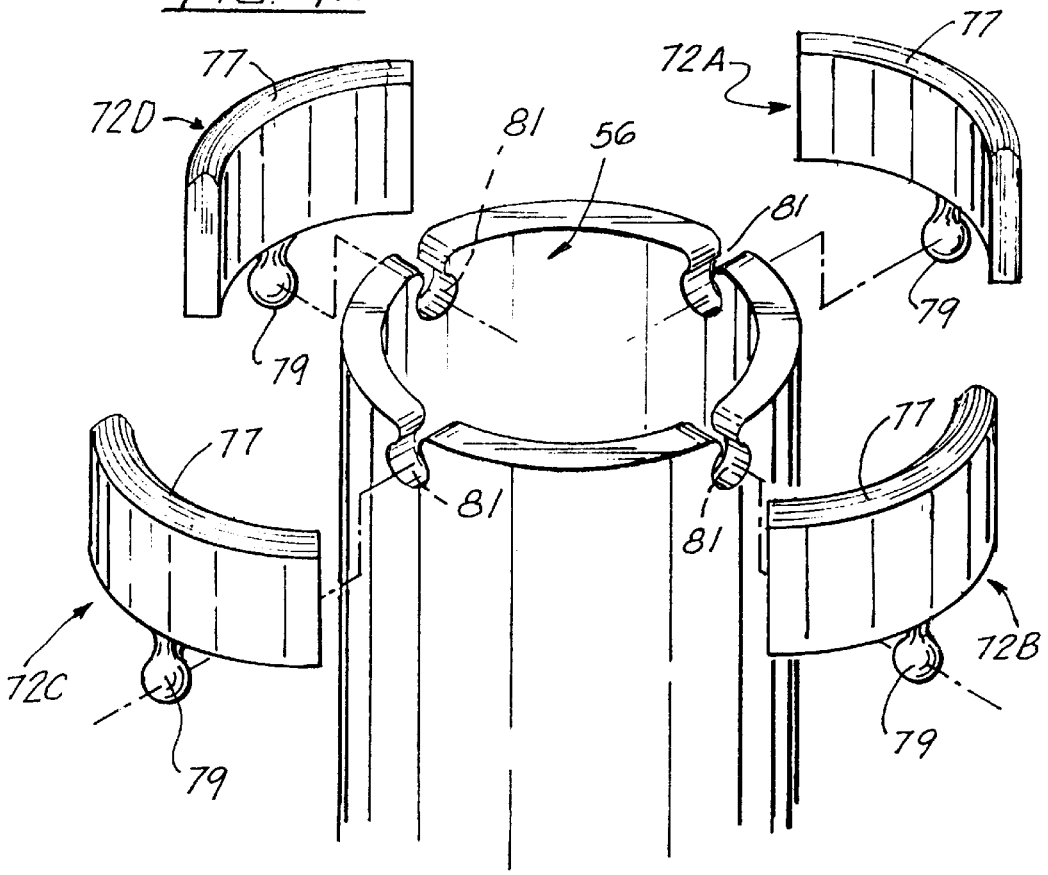
Figure 11A:
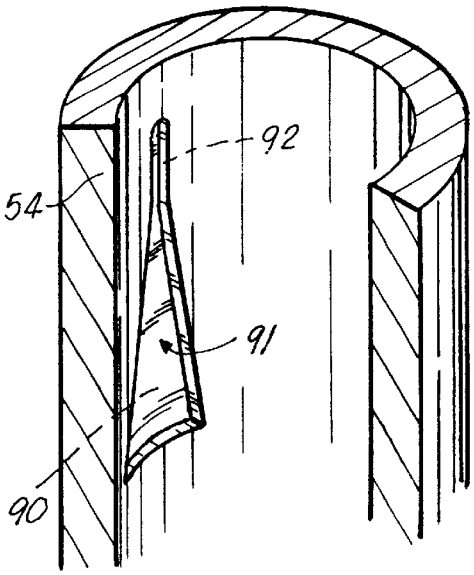
Figure 11B:
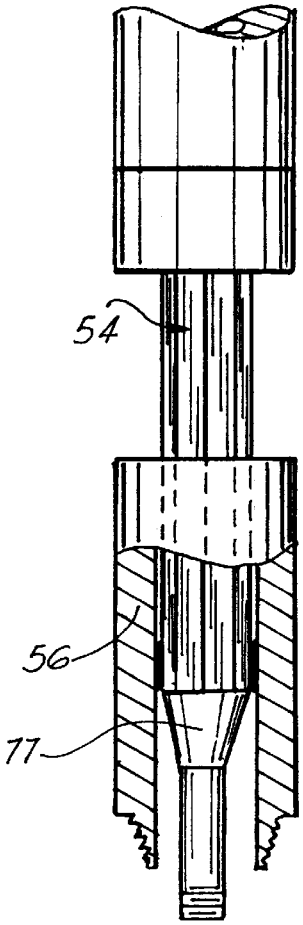
FIGS. 11B and 11C illustrate the drill collars and tension tube utilized in the present invention.
Figure 11C:
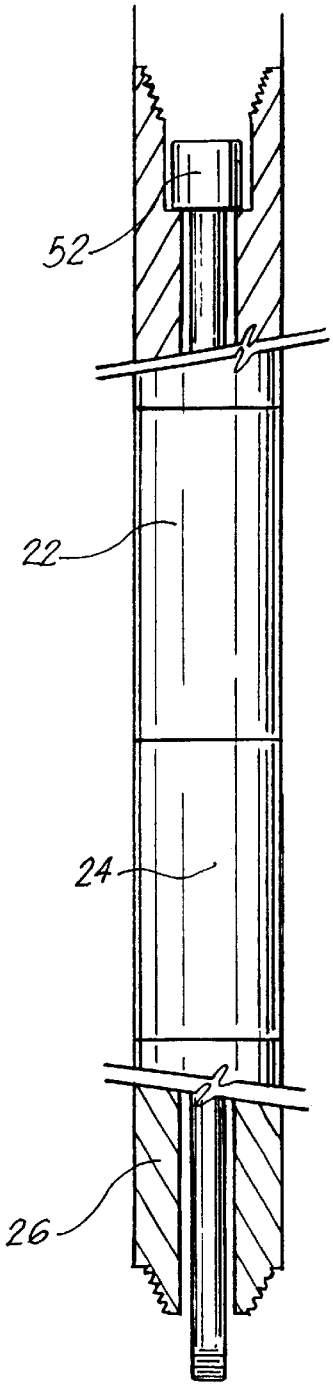

FIGS. 9A through 9B illustrate the latch mechanism 72 in its component parts. As seen if FIG. 9A, there is illustrated the latch means 72 positioned atop the piston body 76. There is also illustrated the concavity or conical groove 70 in body 56, in which the latch 72 is positioned. In this position, the tool is cocked and unfired, as seen in FIG. 6B. FIG. 10 illustrates the groove 90 which is formed completely around the wall of tension tube 34, into which latch 72 would slide to trigger the apparatus, as discussed earlier in FIG. 8.

For understanding the relationship between latch means 72 and the piston body 76, reference is made to FIG. 9B. As illustrated, the latch means 72 comprises four segments 72A through 72D which include a quarter-round an upright body portion 77 and a lower dovetail oval-shaped portion 79 which would engage into a dovetail oval-shaped opening 81 in piston 76. Therefore, when each of the segments 72A through 72D are engaged in openings 81, the latch means 72 is formed in the circular configuration for operating in the tool. This engagement as provided, allows the movement of the latch member 72 from the position engaged in groove or concavity 70 while the tool is cocked, to the position in groove or concavity 90, when the tool is fired. Again, FIG. 10 illustrates the groove 90 formed in the wall of the tension tube 34 which receives the four components 72A through 72D when the tool is fired.

Although some discussion was made earlier regarding the hydraulic fluid reservoir 78, its function as a primary metering device has not been fully discussed. Returning first to FIG. 7, which illustrates the tool cocked and ready for firing. In the event that a driller should decide not to fire the apparatus after the apparatus is in position for firing as illustrated in FIG. 7, or the driller would make a decision to raise the entire drill string due to freeing of the pipe, the spring member 68 together with the hydraulic piston 76, with the hydraulic flange 77 and the latch mechanism 72 will slowly move downward and release the stored energy of the jarring mechanism within a designed period of time. The further reduction of recessed area 90 at point 94 would allow the driller to lower the drill string to fire the jar immediately with minimum loss of the spring member 68 compression due to the varying hydraulic bleed of the hydraulic metering system in place. As was stated earlier, as the actuator is lowered to its length, in the stroke, the compression in the spring 68 is maintained by the hydraulic pressure within hydraulic fluid reservoir 78, by means of a one-way check valve 84. When the machine opening 90 of the tension tube actuator 54 reaches the segmented latch mechanism 72, the latch mechanism 72 is then forced out of the way of the hydraulic piston 76, releasing the lower portion 42 of the tool 10 to impact the shoulder 40 of the jarring tool 52 at impact surface 38.

Therefore, if the tension tube actuator 34 is not lowered within a few minutes of the raising of the drill string, the hydraulic metering assembly will slowly uncock the spring 68 as the hydraulic fluid 81 within the reservoir 78 moves slowly from the lower portion to the upper portion of the reservoir. In this manner, the tension in the spring 68 will be released long before the jarring tool 52 reaches the surface eliminating a potential safety hazard.

After the tool has either fired or moved into the position of having been uncocked as described above, the tool then must be "re-cocked" in order to undertake an additional firing. For example, in FIG. 8 there is illustrated the tool after the hammer 52 has fired and the latch means has moved from the cocked position set within opening 70, to the firing position after it is moved into opening 90. Of course, after the tool has fired, it is necessary to recock the tool into the position as seen in FIG. 7. Therefore, the tension tube 34 must be lowered into position so that the latch 72 would reengaged into opening 70. In order to accomplish this, the hydraulic fluid 81 must be re-bled back into the lower portion of the reservoir 78. Since the return of the fluid in that manner would result in the tool being recocked very slowly, reference is made to FIG. 11A, where there is illustrated a secondary metering component 91, which is an opening formed in the wall of tension tube actuator portion 54 so that the hydraulic fluid may flow into the metering component 91 and allow the tool to be recocked rather quickly rather than having to allow for the fluid to completely flow to the lower portion of the reservoir 78. After this is accomplished, the tool is ready to be refired as seen in FIG. 7.

In conclusion, the present invention can provide significantly more compressive force to jar with, as tension is easily applied to the apparatus, whereas in conventional jars, precompression is difficult to achieve due to the buckling of the drill string, especially in horizontal directional drilling operations. With the present invention, one can also jar over a much longer stroke than existing jars due to the fact that the tool decouples the drill string from the jarring apparatus via the tube member 34. Instead of a 4 to 6 inch jarring stroke, a massive jarring stroke of from 3–5 feet can be obtained with the apparatus of the present invention. The result in order of magnitude, is approximately ten fold, of an increase of inline jarring energy. In this invention, the jarring mass of the three interconnected drill collars spans a total of 95 feet. In existing art, the typical drill string must move over several thousands of feet to effect a conventional jarring system.

PARTS LIST

| | |
|---|---|
| apparatus | 10 |
| first upper section or member | 12 |
| drill pipe, coil tubing, wireline | 14 |
| second lower inember | 16 |
| tool or drill pipe | 18 |
| third jarring member | 27 |
| drill collars | 22, 24, 26 |
| actuator sub | 30 |
| attachment portion | 32 |
| tension tube portion | 34 |
| shoulder | 38 |
| shoulder | 40 |
| upper portion | 42 |
| tension tube actuator portion | 54 |
| upper head portion | 52 |
| outer body | 56 |
| flanged collar connector | 58 |
| internal shoulder | 60 |
| o ring | 62 |
| outer flange | 66 |
| spring ineans | 68 |
| cylindrical body | 64 |
| concavity | 70 |
| latch means | 72 |
| four segments | 72A–72D |
| flanged collar portion | 74 |
| hydraulic piston | 76 |
| lower end | 77 |
| hydraulic fluid reservoir | 78 |
| upper flanqe collar | 80 |

-continued

| PARTS LIST | |
|---|---|
| lower flange collar | 82 |
| hydraulic fluid | 81 |
| access screws | 83 |
| O ring | 85 |
| check valve portion | 84 |
| one way check valve | 86 |
| conical groove | 90 |
| body portion | 77 |
| dovetail oval shape portion | 79 |
| oval shaped opening | 81 |
| recessed area | 90 |
| secondary metering component | 91 |
| bleed area | 92 |
| point | 94 |

The foregoing embodiments are presented by way of example only; the scope of the present invention is to be limited only by the following claims.

What is claimed is:

1. An apparatus for dislodging stuck tools downhole, comprising:

a. a first attachment means for attaching to the upper end of the stuck tool;

b. a second attachment means for attaching to a length of tubing above the apparatus;

c. a third means a spring member for storing compressional force as the tubing above the apparatus applies upward force on the apparatus, and for providing jarring force against the first attachment means to jar the stuck tool loose, without imparting force upon the second attachment means; and d. actuating means for rapidly releasing the jarring force downward onto the tool lodged downhole.

2. The apparatus in claim 1, further comprising a slow release mechanism for slowly releasing the compressional forced stored by the spring means in the event the tool is not fired.

3. The apparatus in claim 2, wherein the slow release mechanism comprises hydraulic fluid housed within a reservoir in the apparatus defining a hydraulic metering means.

4. The apparatus in claim 1, wherein the actuating means further comprises a latching member for maintaining a spring means in its compressed position, and for releasing the spring means when the actuating means is fired.

5. The apparatus in claim 4, wherein the latching member further comprises a segmented latch mechanism of a plurality of segmented elements.

6. The apparatus in claim 1, wherein the second means comprises an interior tubular member threadably secured to an upper tubular section.

7. The apparatus in claim 1, wherein the first means comprises a lower portion of tubing threadably engaged to the lodged tool.

8. The apparatus in claim 4, wherein the latch member is engaged in a hallowed out portion of a jarring means while compressive force is stored, and moves into a hollowed out portion in an inner tubular member when the compressive force is released.

9. A method of dislodging a stuck tool downhole, comprising the following steps:

a. providing a jarring apparatus above the stuck tool, the jarring apparatus having first, second, and third components;

b. attaching a lower end of the first component to an upper end of the stuck tool;

c. attaching an upper end of the second component to a length of tubing or wireline;

d. imparting upward force on the second component by the tubing or wireline sufficient to transfer the upward force to compressional force within the third component;

e. rapidly releasing the compressional force within the third component downward against the first component attached to the stuck tool sufficient to dislodge the stuck tool, without imparting force on the tubing or wireline attached to the upper end of the second component.

10. The method in claim 9, wherein the second and first components of the apparatus are threadably engaged to the tubing or wireline above the apparatus and to the stuck tool below the apparatus respectively.

11. The method in claim 9 wherein the upward force imparted on the apparatus is provided by pulling upward on the tool attached to the apparatus, so that an inner tension member provides compressional force.

12. The method in claim 9, wherein the tubing would comprise drill pipe.

13. The method in claim 9, wherein the compressional force is provided by a tension member compressing a spring means within the apparatus.

14. The method in claim 9, wherein the release of the compressional force is provided by an actuating mechanism releasing the compressional force rapidly as it shifts within the apparatus.

15. The method in claim 9, further comprising the step of providing a metering means for metering the release of the compressional force slowly in the event the tool is not fired but is retrieved from the borehole.

16. An apparatus for dislodging tools downhole, comprising:

a. a first attachment means for attaching to the upper end of the lodged tool;

b. a second attachment means for attaching to a length of coil tubing or wireline above the apparatus;

c. a spring mechanism within the apparatus for storing compressional forced as the length of coil tubing or wireline above the apparatus applies upward force on the apparatus;

d. an actuating means for rapidly releasing the stored compressional force downward onto the tool lodged downhole through the shift of a latching mechanism; and e. means from preventing force from being impacted on the coil tubing or wireline above the apparatus when the compressional force is imparted on the lodged tool.

17. The apparatus in claim 16, further comprising a slow release mechanism for slowly releasing the compressional forced stored by the spring mechanism should the tool not be fired within a given amount of time.

18. The apparatus in claim 16, wherein the latching member further comprises a segmented latch mechanism of a plurality of segmented elements.

19. The apparatus in claim 16, comprising a plurality of concentric tubular members, wherein the innermost member is secured to the tubing or wireline, the outer most member is secured to the lodged tool, and the member between the inner most and outer most members comprises the actuating means for imparting downward force on the lodged tool.

20. The apparatus in claim 16, wherein the segmented latch mechanism further comprises a plurality of segmented elements which include concave and convex surfaces for allowing contraction and expansion of the latching mechanism.

21. The apparatus in claim 18, wherein the segmented latch mechanism is engaged in a hollowed out portion of an outer tubular member while compressive force is stored, and moves into a hollowed out portion of an inner tubular member when the compressive force is released.

22. A method of dislodging a stuck tool downhole, comprising the following steps:

a. providing a jarring apparatus above the stuck tool;

b. attaching a lower end of the jarring apparatus to an upper end of the stuck tool;

c. attaching an upper end of the jarring apparatus to a length of drill pipe, tubing or wireline;

d. imparting upward force on the jarring apparatus by the drill pipe, tubing or wireline sufficient to transfer the upward force to stored compressional energy within the jarring apparatus;

e. rapidly releasing the stored compressional energy within the jarring apparatus downward sufficient to dislodge the stuck tool.

23. The method in claim 22, wherein the stored compressional energy within the jarring apparatus is released without imparting force on the drill pipe, tubing or wireline attached to the upper end of the jarring apparatus.

24. The method in claim 22, wherein the stored compressional energy is defined by a spring means.

25. A method of dislodging a stuck tool downhole, comprising the following steps:

a. providing a jarring apparatus above the stuck tool, the jarring apparatus having multiple components;

b. attaching a lower end of a first component to an upper end of the stuck tool;

c. attaching an upper end of a second component to a length of drill pipe, tubing or wireline;

d. imparting upward force on the second component by the drill pipe, tubing or wireline sufficient to transfer the upward force to stored compressional energy within the jarring apparatus;

e. rapidly releasing the stored compressional energy within the jarring apparatus downward against the first component attached to the stuck tool sufficient to dislodge the stuck tool, without imparting force on the drill pipe, tubing or wireline attached to the upper end of the second component.

26. An apparatus for dislodging stuck tools downhole, comprising:

a. a first attachment means for attaching to the upper end of the stuck tool;

b. a second attachment means for attaching to a length of drill pipe, tubing or wireline above the apparatus;

c. means for storing compressional energy as the drill pipe, tubing, or wireline above the apparatus applies upward force on the apparatus;

d. means for rapidly releasing the stored compressional energy providing downward jarring force against the first attachment means to jar the stuck tool loose.

27. The apparatus in claim 26, further comprising an actuating means for rapidly releasing the stored compressional energy providing jarring force downward onto the tool lodged downhole.

* * * * *